United States Patent [19]

Bryans et al.

[11] 4,353,041

[45] Oct. 5, 1982

[54] SELECTABLE LINEAR OR CIRCULAR POLARIZATION NETWORK

[75] Inventors: Lawrence G. Bryans, Mountain View; Loren R. Murchison, Santa Clara, both of Calif.

[73] Assignee: Ford Aerospace & Communications Corp., Detroit, Mich.

[21] Appl. No.: 209,804

[22] Filed: Nov. 24, 1980

Related U.S. Application Data

[63] Continuation-in-part of Ser. No. 100,675, Dec. 5, 1979, abandoned.

[51] Int. Cl.[3] ..... H01P 1/165; H01P 1/17

[52] U.S. Cl. ..... 333/21 A; 333/257

[58] Field of Search ..... 333/21 A, 257

[56] References Cited

U.S. PATENT DOCUMENTS 4,087,746 5/1978 Kanae ..... 333/21 A X

*Primary Examiner*—Paul L. Gensler

*Attorney, Agent, or Firm*—Edward J. Radlo; Robert D. Sanborn; Peter Abolins

[57] ABSTRACT

This specification discloses a polarization network for selectively converting between linear and circular polarization. The network includes a twistable waveguide having a generally rectangular cross section. Coupled to the twistable rectangular waveguide is a transducer waveguide which acts as an interface between the rectangular waveguide and circular waveguide. A polarizer having a generally circular cross section is coupled to the transducer waveguide and can convert transmitted electromagnetic waves between linear and circular polarization. A coupling means permits relative rotation between the transducer waveguide and the polarizer and selective securing at any of three rotational positions. A first position permits a linearly polarized signal to pass through the polarizer remaining linearly polarized. A second position converts between a linearly polarized signal and a right hand circularly polarized signal. A third position converts between a linearly polarized signal and a left hand circularly polarized signal. Second coupling means between the polarizer and circular horn waveguide permits arbitrary orientation of a linearly polarized signal within the cross-sectional plane.

6 Claims, 4 Drawing Figures

(SHOWN LINEARLY POLARIZED)

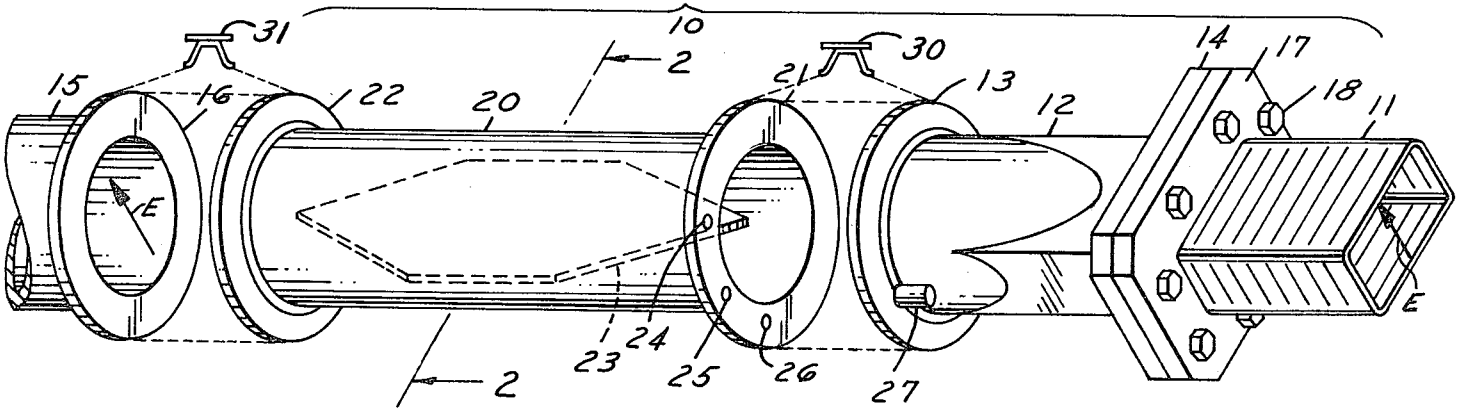
FIG. 1 (SHOWN LINEARLY POLARIZED)
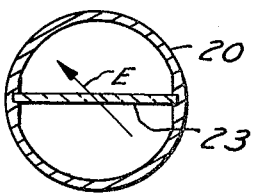
FIG. 4
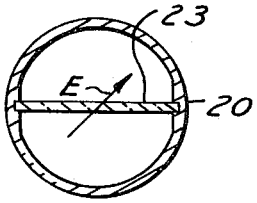
FIG. 3
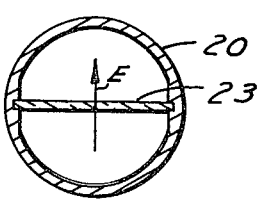
FIG. 2

SELECTABLE LINEAR OR CIRCULAR POLARIZATION NETWORK

This is a continuation-in-part of U.S. Patent application Ser. No. 100,675, filed Dec. 5, 1979, now abandoned.

BACKGROUND OF THE INVENTON

1. Field of the Invention

This invention relates to a polarization network for converting between linearly polarized signals and circularly polarized singals, and for changing the orientation of linearly polarized signals.

2. Prior Art

The prior art teaches a variety of ways to convert a linearly polarized microwave signal to a circularly polarized microwave signal and vice versa. For example, the transformation between linear and circular polarization can be accomplished by a septum polarizer. A septum polarizer usually is a threeport waveguide device, where the number of ports refers to physical ports. It may be formed by two rectangular waveguides that have common wide or H-plane walls. The two rectangular waveguides are transformed by a sloping septum into a single square waveguide. Various prior art septum polarizer designs are illustrated and described in U.S. Pat. No. 3,958,193 issued May 18, 1976 to James V. Rootsey, assigned to Aeronutronic Ford Corporation, now Ford Aerospace & Communications Corporaton, the assignee of the present invention.

In a septum polarizer, a linerarly polarized transverse electric field microwave signal is converted, through the action of the septum, into a circularly polarized (CP) microwave signal and vice versa. The linearly polarized signal is introduced into one of the two rectangular waveguide ports and produces in the square waveguide port a microwave signal having either right-hand circular polarization (RHCP) or left-hand circular polarization (LHCP). Whether RHCP or LHCP is produced depends upon which of the two rectangular waveguide ports is excited. It is possible and in some applications very desirable to introduce simultaneously in both of the rectangular waveguide ports linearly polarized signals to produce in the square waveguide port both RHCP and LHCP signals, or vice versa. The two linearly or circularly polarized signals may constitute separate information channels. If the RHCP and LHCP signals co-existing in the square waveguide port have perfect circular polarization characteristics, they are completely isolated from one another and there is no interference between them.

A perfect CP signal has a rotating electric field that can be regarded as the vector resultant of two orthogonal components Ex and Ey having sinusoidally varying magnitudes that are exactly equal in amplitude but 90° out of phase with one another. The closer simultaneously existing RHCP and LHCP signals come to the perfect CP signal, the greater is the isolation between them. The axial ratio AR is the ratio of Ex to Ey and is an indication of the degree to which a CP signal has departed from the ideal. In dB, the axial ratio AR is equal to 20 log Ex/Ey. Perfect CP signals have an AR of 0 dB.

Another known means for generating various combinations of right and left hand circular polarized waves is a microwave switch. The polarized waves are applied to directional filters which direct the right hand waves to a first antenna system while the left hand waves are directed to another antenna system. A well known microwave switch is the Faraday rotator which includes a rotator section for rotating the polarization of the linear signal and a quarter wave plate for generating a predetermined amount of right hand and/or left hand circular polarized waves.

The rotator section is made up of a cylindrical waveguide member having an input port to which a linearly polarized wave is applied. A ferrite rod is axially suspended within the cylindrical waveguide and a coil is mounted about the outer circumference of the waveguide, coaxial with the ferrite rod. As current is applied to the coil, a magnetic field is induced in the ferrite rod which causes the plane of polarization of the linear wave to be rotated in an angle and sense or direction which is proportional to the current applied.

The linear signal having its plane of polarization rotated is then applied to another cylindrical waveguide member having a quarter wave plate therein for generating right hand and left hand circular polarized waves. Thus, the ratio of right hand to left hand circular polarized waves is determined by the current applied to the coil.

The Faraday rotator is relatively bulky and heavy, and requires continuous power to maintain a particular angle of the plane of polarization of the linear wave. In addition, the output signal of the Faraday rotator is temperature sensitive. For example, environmental temperature changes cause the permeability of the ferrite rod to vary, which in turn varies the plane of polarization of the linearly polarized wave. Thus, as the temperature changes so does the ratio of right-hand to left-hand polarized waves.

Another method of rotating the linear polarization of a wave is to use an electrically rotated quarter wave plate. This method uses a ferrite tube in a circular waveguide having a quadrupole field around the waveguide. The ferrite tube is transversely magnetized by the quadrupole magnetics to rotate the plane of polarization of the input wave. Also, an A/C motor stator arrangement may be used in place of the quadrupole arrangement for electrically rotating the magnetic field about the waveguide. The drawbacks of such an arrangement are that such a device is heavy, inefficient, and in addition requires a holding current.

The prior art also teaches that selectable left or right hand circular polarization and linear polarization can be provided by two 90° polarizers. Clearly, the use of two polarizers is less desirable than being able to use only one. This is particularly true in any antenna feed or microwave application requiring selectable circular and linear polarization. These are some of the problems this invention overcomes.

Representative of the prior art are U.S. Pat. Nos. 2,858,512, 3,296,558, 3,857,112, and 4,060,781.

SUMMARY OF THE INVENTION

A first waveguide, coupled to a transmitter and/or receiver, has a generally rectangular cross section and is twistable about its longitudinal axis. Rigidly coupled to one end of the rectangular waveguide is a transducers waveguide which acts as an interface between the rectangular waveguide and the remaining waveguide in the network, all of which has a circular cross-section. A cylindrical polarizer waveguide having a generally circular cross section and containing a dielectric or other polarization means is coupled to the transducer waveguide and converts transmitted electromagnetic waves between linear and circular polarization. A coupling means permits relative rotation between the transducer waveguide and the polarizer to any of three rotational positions. A first position permits a linearly polarized signal to pass through the polarizer remaining linearly polarized. A second position converts beteen a linearly polarized signal and a right hand circularly polarized signal. A third position converts between a linearly polarized signal and a left hand circularly polarized signal. The orientation of the input linear field relative to the dielectric or other polarizing means determines the output polarization. Coupled to the other end of the polarizer waveguide is a horn waveguide having a circular cross-section.

For adjusting the orientation of a linearly polarized signal, the polarizer is rotated with respect to the horn waveguide while keeping fixed the spatial relationship between the polarizer and the transducer, thus changing the orientation of the linear polarization with respect to the cross-section of the horn waveguide.

An advantage of a polarization network in accordance with this invention is that only one polarizer is required to obtain a desired left or right hand circular polarization or linear polarization of any spatial orientation.

BRIEF DESCRIPTION OF THE DRAWINGS

FIG. 1 is a perspective exploded view of a polarization network in accordance with an embodiment of this invention.

FIG. 2 is a section view taken along line 2—2 of FIG. 1 with the relative rotation between waveguides 12 and 20 as shown in FIG. 1;

FIG. 3 is a section view taken along line 2—2 with the field rotated with respect to the dielectric plate within the polarizer in such a way as to produce right hand circular polarization; and FIG. 4 is a section view taken along line 2—2 with the field rotated with respect to the dielectric plate within the polarizer in such a way as to produce left hand circular polarization.

DETAILED DESCRIPTION OF THE INVENTION

Referring to FIG. 1, polarization network 10 includes a serial coupling of waveguide components including twistable flexible rectangular waveguide 11, transducer 12, and polarizer 20. Network 10 is normally coupled at its left end to circular horn waveguide 15 and at its right end to a microwave transmitter and/or receiver. Polarizer 20 is relatively rotatable with respect to transducer 12 so that various polarizations can be achieved. Additionally, one can keep the orientation of flange 21 fixed with respect to flange 13 and at the same time rotate flange 22 with respect to flange 16 so that the orientation of the linearly polarized E-vector within the circular cross-section 15 can be adjusted as desired to match with the E-vector orientation of the device that communicates with the device of which network 10 forms a part.

As used herein, a "mode transducer" such as transducer 12 is a device that transmits power from one type of transmission line to another, whereas a "transformer" is an adapter used between waveguides or between coaxial cables to join transmission lines of different sizes and/or with overlapping frequency ranges.

The coupling means between polarizer 20 and transducer 12 includes three detents 24, 25, and 26 arcuately spaced 45° from each other on circular flange 21 of polarizer 20. The detents selectively mate with pin 27 on circular flange 13 of transducer 12. The three discrete positions permit right hand circular polarization when detent 24 is engaged by pin 27, linear polarization when detent 25 is engaged by pin 27, and left hand circular polarization when detent 26 is engaged by pin 27.

Waveguide 11 has a generally rectangular cross section and is twistable about its longitudinal axis, i.e., its right end is fixedly coupled to the waveguide that forms a part of the microwave transmitter and/or receiver, while the left end can be twisted to rotate the rectangular cross-section up to 90° in either a clockwise or counterclockwise direction. (For purposes of illustration, the length of waveguide 11 is depicted as being optimistically short to provide the up to 180° to twist specified.) The left end of waveguide 11 terminates in rectangular flange 17 which rigidly mates with rectangular flange 14 of transducer 12. Flanges 17 and 14 can be secured to each other by means of bolts 18. Linearly polarized radiation propagating within waveguide 11 will always be aligned so that its E-vector is orthogonal to the widest two walls of waveguide 11. Thus, twisting waveguide 11 has the effect of twisting the orientation of the E-vector of the linearly polarized signal that propagates within. A total twist of 180° is sufficient to give total freedom in alignment because changing the direction of the E-vector by 180° is of no import.

Moving from right to left, the cross section of transducer 12 gradually changes from rectangular (adjacent flange 14) to circular (adjacent flange 13). Typically, pin 27 on flange 13 is a spring loaded pin which can be grasped on one side of flange 13 and has a portion extending through flange 13 for engaging any one of detents 24, 25 and 26.

Polarizer 20 is a cylindrical waveguide which has a generally circular cross section and has a right end terminating in flange 21, which engages flange 13 of transducer 12. The relative rotational position of flange 21 with respect to flange 13 is determined by the detent and pin combination. Flanges 21 and 13 are held together by V-band clamp 30. The interior of polarizer 20 includes flat dielectric plate 23 which generally extends across the inside diameter of polarizer 20. Plate 23 has a six-sided shape comprising a rectangle with triangles affixed to the remotest ends of the rectangle. Plate 23 causes rotation of the electromagnetic radiation because it slows down the component of the polarization vector parallel to plate 23 but does not slow down the component perpendicular to plate 23.

Circular waveguide 15, which is normally a horn, has a generally circular cross section and terminates at the right in circular flange 16, which mates with circular flange 22 of polarizer 20. Flanges 22 and 16 are joined by V-band clamp 31. Normally, the circular cross-section of waveguide 15 increases in diameter as we move from right to left in FIG. 1.

Referring to FIGS. 2, 3 and 4, the angular position of dielectric plate 23 with respect to the electric field vector (E-vector) of an electromagnetic wave propagating from right to left is shown in three embodiments. FIG. 2 shows that to obtain linear polarization, the electric field vector of the electromagnetic wave must be perpendicular to plate 23 (this corresponds to the embodiment shown in FIG. 1). FIG. 3 shows that to obtain right hand circular polarization, the direction from the arrow head of the E-vector to the nearest side of plate 23 must be clockwise, with a 45° angle between the E-vector and plate 23. This corresponds to the use of detent 24.

FIG. 4 shows that to obtain left hand circular polarization, the direction from the arrow head of the E-vector to the nearest side of plate 23 must be counter clockwise, with a 45° angle between the E-vector and plate 23. This corresponds to the use of detent 26.

In operation, any of a number of polarizations can be selected by relative positioning among the elements of polarization network 10. Linear polarization can be achieved by positioning transducer 12 so as to engage linear detent 25 of polarizer 20. V-band clamp 30 coupling transducer 12 to polarizer 20 is then tightened. Polarizer 20 is then rotated with respect to circular waveguide 15 to produce the desired orientation of the linearly polarized radiation's E-vector within the cross-sectional plane of waveguide 15. In other words, it may very well be that in order to optimize the performance of the antenna system fed by waveguide 15, it is necessary for the E-vector to point in a certain direction in the plane defined by the cross-section of cylinder 15 so as to line up with a remote transmitter or receiver. The direction of the E-vector as it radiates in the space to the left of waveguide 15 (in transmit mode) may be varied by rotating polarizer 20 (which has now been rigidly joined to transducer 12) with respect to waveguide 15 because the E-vector within twistable waveguide 11 is always aligned orthogonal to the widest two walls of waveguide 11, which is fixed at its right end and twisted at its left (flange 17) end. After the relative rotation between waveguide 15 and polarizer 20 has been performed, clamp 31 is tightened.

Right hand circular polarization or left hand circular polarization is achieved by positioning polarizer 20 with respect to transducer 12 so that either the right hand circular polarization detent 24 or left hand polarization detent 26 is engaged by pin 27. To make this adjustment, clamp 30 is first loosened. However, for circularly polarized radiation, there is no need to effectuate relative rotation between polarizer 20 and circular waveguide 15, because in this case the E-vector rotates in the cross-sectional plane.

Polarization network 10 is suitable for either receiving or transmitting electromagnetic signals. If the antenna system is used as a receiver rather than a transmitter, the energy flows from left to right in FIG. 1 and an incoming linearly polarized signal will remain linearly polarized or be converted to LHCP or RHCP depending upon the orientation of its E-vector with repsect to plate 23.

Various modifications and variations will no doubt occur to those skilled in the various arts to which this invention pertains. For example, the particular means of polarizing within the polarizer may be varied from that described herein: e.g., polarizer 20 can be a circularly cylindrical waveguide with a longitudinal row of pins on opposing interior walls. Transducer 12 can be a dual mode transducer with a resistive termination on one of the orthogonal ports or with both ports actively used. The connection means between flanges 21 and 13, and/or between flanges 16 and 22, can be varied from that described herein, e.g., the relative rotation can be accomplished by motarized mechanisms. Or, the detents can be on flange 13 and the pin on flange 21. These and all other variations which basically rely on the teachings through which this disclosure has advanced the art are properly considered within the scope of this invention.

We claim:

1. A polarization network for selectively converting between linear and circular polarization comprising:

a rectangular waveguide means having a generally rectangular cross section and being twistable about its longitudinal axis;

a transducer waveguide means for interfacing between said rectangular waveguide means and circular waveguide, said transducer waveguide means having a first end having a generally rectangular cross section coupled to said rectangular waveguide means and a second end having a generally circular cross section;

a polarizer having a third end and a fourth end, said third end being coupled to said second end, said polarizer being adaptable to change electromagnetic radiation between linear and circular polarization; and a first coupling means to permit relative rotation between said transducer waveguide means and said polarizer to any of three rotational positions: a first position permitting a linearly polarized signal to remain linearly polarized after passing through said polarizer, a second position converting between a linearly polarized signal and a right hand circularly polarized signal, and a third position converting between a linearly polarized signal and a left hand circularly polarized signal.

2. A polarization network as recited in claim 1 wherein said polarizer is a circularly cylindrical hollow waveguide having an internal dielectric plate, said plate being generally planar and having at least one portion extending along an inner diameter of said polarizer.

3. A polarization network as recited in claim 1 wherein said first coupling means includes three detents spaced around a flange on one of said polarizer and transducer waveguide means plus a securing pin means for selectively mating with one of said detents, said securing pin means being on a flange of the other of said polarizer and transducer waveguide means.

4. The network of claim 1 further comprising a horn waveguide means and a second coupling means for rotationally coupling said fourth end to said horn waveguide means.

5. A polarizer network as recited in claim 4 wherein said second coupling means comprises:

flanges at each of said fourth end and the corresponding extremity of said horn waveguide means; and a first clamp means for securing adjacent flanges of said polarizer and said horn waveguide means;

wherein said network further comprises a second clamp means for securing flanges of said second end and said third end.

6. A polarizer network as recited in claim 5 wherein the flanges at each of said fourth end and the corresponding extremity of said horn waveguide means have mating surfaces in the shape of flat rings, so that said polarizer and said horn waveguide means are arbitrarily rotatably oriented with respect to each other, thus allowing, within a cross-sectional plane of said horn waveguide means, the arbitrary orientation of linearly polarized electromagnetic radiation that emanates from said polarizer.

* * * * *